US010285563B2

(12) United States Patent
Beshears, Jr. et al.

(10) Patent No.: US 10,285,563 B2
(45) **Date of Patent: *May 14, 2019**

(54) NON-INTEGRATED BULK DISPENSER AND METHOD OF OPERATING A DISHWASHER HAVING SAME

(71) Applicant: Whirlpool Corporation, Benton Harbor, MI (US)

(72) Inventors: Paul E. Beshears, Jr., Stevensville, MI (US); Sathish A. Sundaram, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/949,711

(22) Filed: Apr. 10, 2018

(65) Prior Publication Data

US 2018/0220866 A1 Aug. 9, 2018

Related U.S. Application Data

(60) Continuation of application No. 15/241,125, filed on Aug. 19, 2016, now Pat. No. 9,999,339, which is a (Continued)

(51) Int. Cl.

| | |
|---|---|
| ***A47L 15/44*** | (2006.01) |
| ***A47L 15/00*** | (2006.01) |
| ***A47L 15/42*** | (2006.01) |

(52) U.S. Cl.

CPC ..... *A47L 15/44* (2013.01); *A47L 15/0047* (2013.01); *A47L 15/0055* (2013.01); *A47L 15/4293* (2013.01); *A47L 15/449* (2013.01); *A47L 15/4463* (2013.01); *A47L 2401/023* (2013.01); *A47L 2401/20* (2013.01); *A47L 2401/26* (2013.01); *A47L 2501/26* (2013.01)

(58) Field of Classification Search

CPC combination set(s) only.

See application file for complete search history.

(56) References Cited

U.S. PATENT DOCUMENTS

| | | | |
|---|---|---|---|
| 2,358,913 | A | 9/1944 | Dobkin |
| 4,063,663 | A | 12/1977 | Larson et al. |

(Continued)

FOREIGN PATENT DOCUMENTS

| | | | |
|---|---|---|---|
| DE | 3342301 | A1 | 5/1985 |
| DE | 102008033239 | A1 | 1/2010 |

(Continued)

OTHER PUBLICATIONS

German Search Report for counterpart DE102012109560.4, dated Aug. 14, 2014.

*Primary Examiner* — Michael E Barr
*Assistant Examiner* — Benjamin L Osterhout
(74) *Attorney, Agent, or Firm* — McGarry Bair PC

(57) ABSTRACT

A dispensing assembly including at least one treating chemistry container configured to store a treating chemistry and selectively fluidly coupled to the treating chamber, a sensor configured to detect a characteristic of the dispensing assembly and output a first signal based thereon, an illumination detector outputting a second signal indicative of ambient illumination and an indicator outputting a human-detectable signal.

20 Claims, 5 Drawing Sheets

Related U.S. Application Data continuation of application No. 14/134,473, filed on Dec. 19, 2013, now Pat. No. 9,420,935, which is a continuation of application No. 13/608,034, filed on Sep. 10, 2012, now Pat. No. 8,627,984, which is a division of application No. 12/952,571, filed on Nov. 23, 2010, now Pat. No. 8,337,628.

(56) References Cited

U.S. PATENT DOCUMENTS

| | | | | |
|---|---|---|---|---|
| 4,916,439 | A | 4/1990 | Estes et al. | |
| 4,921,129 | A | 5/1990 | Jones et al. | |
| 5,417,233 | A | 5/1995 | Thomas et al. | |
| 5,500,050 | A | 3/1996 | Chan et al. | |
| 5,839,454 | A | 11/1998 | Matz | |
| 7,096,601 | B2 | 8/2006 | Lyu et al. | |
| 7,722,723 | B2 | 5/2010 | Classen et al. | |
| 8,337,628 | B2 | 12/2012 | Beshears, Jr. et al. | |
| 9,420,935 | B2 | 8/2016 | Beshears, Jr. et al. | |
| 2002/0088502 | A1 | 7/2002 | Van Rompuy et al. | |
| 2005/0068912 | A1 | 3/2005 | Scott et al. | |
| 2006/0208899 | A1 | 9/2006 | Suzuki et al. | |
| 2007/0144558 | A1 | 6/2007 | Classen et al. | |
| 2007/0151584 | A1* | 7/2007 | Omachi | A47L 15/0021 134/56 D |
| 2007/0261722 | A1 | 11/2007 | Classen et al. | |
| 2008/0110479 | A1 | 5/2008 | Veening et al. | |
| 2008/0186170 | A1 | 8/2008 | Schleifer et al. | |
| 2009/0235962 | A1* | 9/2009 | Classen | A47L 15/4454 134/57 D |
| 2009/0288453 | A1 | 11/2009 | Lee et al. | |
| 2010/0000023 | A1 | 1/2010 | McAllister et al. | |
| 2010/0000024 | A1 | 1/2010 | Hendrickson et al. | |
| 2010/0000265 | A1 | 1/2010 | Hendrickson et al. | |
| 2010/0000578 | A1 | 1/2010 | Hendrickson et al. | |
| 2010/0033949 | A1 | 2/2010 | Hering et al. | |
| 2010/0132748 | A1 | 6/2010 | Kessler et al. | |
| 2011/0085287 | A1 | 4/2011 | Ebrom et al. | |
| 2011/0174341 | A1 | 7/2011 | Kessler et al. | |
| 2011/0180118 | A1 | 7/2011 | Schrott et al. | |
| 2011/0226808 | A1 | 9/2011 | Lonski et al. | |
| 2012/0073335 | A1 | 3/2012 | Dunsbergen et al. | |
| 2012/0075635 | A1 | 3/2012 | Dunsbergen et al. | |
| 2012/0125384 | A1* | 5/2012 | Beshears, Jr. | A47L 15/0047 134/56 D |
| 2014/0014684 | A1 | 1/2014 | Classen et al. | |
| 2017/0159221 | A1 | 6/2017 | Cho et al. | |

FOREIGN PATENT DOCUMENTS

| | | | |
|---|---|---|---|
| DE | 102009002693 | A1 | 1/2010 |
| DE | 102008053312 | A1 | 4/2010 |
| DE | 102009033477 | A1 | 1/2011 |
| EP | 0678275 | A1 | 10/1995 |
| JP | 2010096587 | A | 4/2010 |
| WO | 2009146691 | A2 | 12/2009 |
| WO | 2010007045 | A2 | 1/2010 |
| WO | 2010007052 | A1 | 1/2010 |
| WO | 2010094393 | A1 | 8/2010 |
| WO | 2010131087 | A1 | 11/2010 |

* cited by examiner

NON-INTEGRATED BULK DISPENSER AND METHOD OF OPERATING A DISHWASHER HAVING SAME

CROSS-REFERENCE TO RELATED APPLICATIONS

The present application is a continuation of U.S. application Ser. No. 15/241,125, filed Aug. 19, 2016, now U.S. Pat. No. 9,999,339, which is a continuation of U.S. application Ser. No. 14/134,473, filed Dec. 19, 2013, now U.S. Pat. No. 9,420,935, which is a continuation of U.S. application Ser. No. 13/608,034, filed Sep. 10, 2012, now U.S. Pat. No. 8,627,984, which is a divisional of U.S. application Ser. No. 12/952,571, filed Nov. 23, 2010, now U.S. Pat. No. 8,337,628, all of which are incorporated by reference herein in their entirety.

BACKGROUND

Contemporary appliances such as a dishwasher may have one or more dispensers for automatically dispensing one or more treating chemistries at an appropriate time during a cycle of operation. One common type of dispenser is the manual or single use dispenser, which can be filled with only enough treating chemistry for a single cycle of operation. Another common type of dispenser is a bulk dispenser, which may contain enough treating chemistry for multiple cycles.

SUMMARY

An aspect of the present disclosure relates to a dishwasher including a tub having an open face and at least partially defining a treating chamber configured for holding dishes during a cycle of operation, a door moveably mounted between an opened position, wherein the treating chamber is accessible, and a closed position, wherein the door closes the open face of the tub, and a dispensing assembly including at least one treating chemistry container configured to store a treating chemistry and selectively fluidly coupled to the treating chamber, a sensor configured to detect a characteristic of the dispensing assembly and output a first signal based thereon, an illumination detector outputting a second signal indicative of ambient illumination, an indicator outputting a human-detectable signal, and a controller receiving the first signal and the second signal and operably coupled to the indicator to activate the indicator to emit the human-detectable signal when the detected amount of illumination is indicative of the open face being at least partially opened and wherein the human-detectable signal is based on the detected characteristic of the dispensing assembly.

Another aspect of the present disclosure relates to a dispensing assembly, comprising at least one treating chemistry container configured to store a treating chemistry and selectively fluidly coupled to the treating chamber, a sensor configured to detect a characteristic of the dispensing assembly and output a first signal based thereon, an illumination detector outputting a second signal indicative of ambient illumination, an indicator outputting a human-detectable signal, and a controller receiving the first signal and the second signal and operably coupled to the indicator to activate the indicator to emit the human-detectable signal when the detected amount of illumination is indicative of a predetermined amount of illumination and wherein the human-detectable signal is based on the detected characteristic of the dispensing assembly.

DETAILED DESCRIPTION

Figure 1:
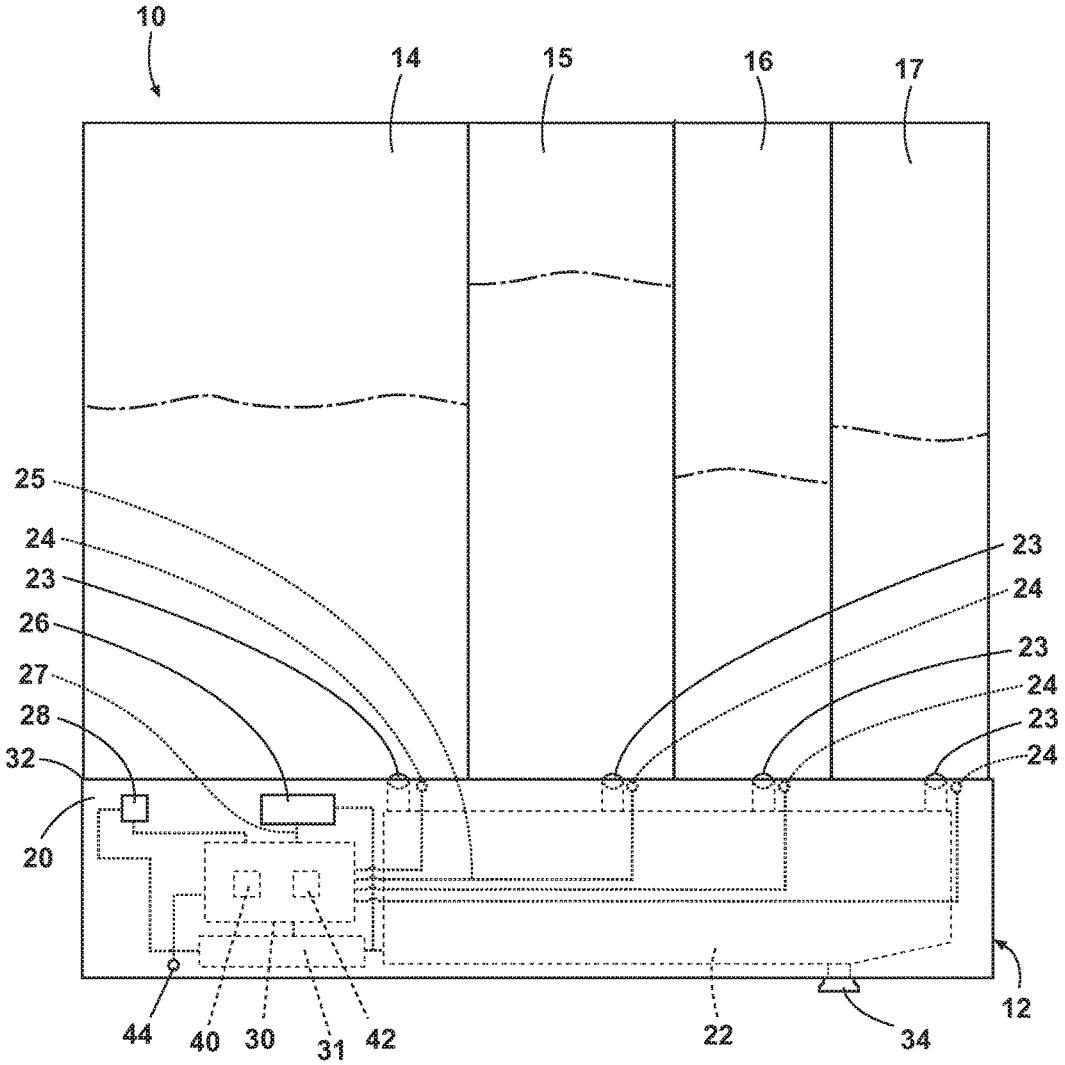
FIG. 1 is a front view of a removable, non-integrated dispenser in accordance with an aspect of the present disclosure.

Referring now to FIG. 1, a removable, non-integrated dispensing cartridge assembly 10 is illustrated. The dispensing cartridge assembly 10 has been illustrated as including a base 12, which may be operably coupled to multiple cartridges 14, 15, 16, 17. The base 12 is formed by a housing 20 and includes a pump assembly 22, a chemistry detector 24 capable of indicating a low level of treating chemistry, an illumination detector 26, at least one indicator 28, a controller 30, and a power source 31.

The multiple cartridges 14-17 may be replaceably mounted within an upper portion 32 of the base 12 for ease of replacement. Each of the multiple cartridges 14-17 forms a treating chemistry reservoir configured to store multiple doses of a treating chemistry stored therein and sufficient for several cycles of operation.

As used herein, the term "multiple doses of treating chemistry", and variations thereof, refers to an amount of treating chemistry sufficient for multiple cycles of operation of an appliance. As used herein, the term "single dose of treating chemistry", and variations thereof, refers of an amount or volume of treating chemistry sufficient for one cycle of operation. The amount or volume of the treating chemistry may vary depending on the selected cycle of operation, but only enough for one cycle is used. As used herein, the term "cycle of operation" refers to one operational cycle of an appliance. When one of the multiple cartridges 14-17 is received within the base 12, the dispensing cartridge assembly 10 functions as a bulk dispensing system.

Although the multiple cartridges 14-17 have been illustrated as box-like containers, the multiple cartridges 14-17 may be any type of removable container configured to store multiple doses of a treating chemistry. The container may have any shape and size so long as it is receivable within the base 12. The removable container may be flexible, rigid, expandable, or collapsible. The container may be made of any type of material. Some examples of suitable cartridges are, without limitation, a plastic container, a cardboard container, a coated cardboard container, and a bladder, all of which are capable of being received within the base 12. Further, the multiple cartridges 14-17 may be of a type where they are replaced when empty or the multiple cartridges 14-17 may be of a type where they may have an opening through which the treating chemistry may be refilled after one or multiple uses.

A pump assembly 22, housed within the base 12, may have multiple inlets 23 coupled to an outlet 34, with the inlets 23 operably coupled to the multiple cartridges 14-17 to establish a metered bulk flow path from the multiple cartridges 14-17 to the outlet 34 and to the environment surrounding the dispensing cartridge assembly 10. Each of the inlets 23 may correspond to one of the multiple cartridges 14-17. The pump assembly 22 may allow for a fractional amount of the entire volume of each of the multiple cartridges 14-17 to be dispensed and it may also allow for a specific volume to be dispensed. More specifically, treating chemistry may be drawn out of one of the multiple cartridges 14-17 by the pump assembly 22 through the pump inlet 23 and may then be pumped out the outlet 34 to the environment surrounding the dispensing cartridge assembly 10.

Although only one outlet 34 has been illustrated in FIG. 1 it is contemplated that multiple outlets 34 may exist. Different types of treating chemistries may be housed in the multiple cartridges 14-17, e.g. a detergent, a drying agent, a spot reducer, a rinse agent, a stain remover, bleach, etc. Some of these treating chemistries may be deleterious to another chemistry's efficacy. Thus, fluidly separate flow paths, including separate pump assemblies and outlets may be provided such that the different types of treating chemistries are not intermingled.

Alternatively, it has been contemplated that the multiple cartridges 14-17 may dispense through the one or more outlets 34 in the base 12 without the aid of the pump assembly 22. In such an instance, the multiple cartridges 14-17 may include an integrated metering device that electronically couples, wired or wirelessly, to the controller 30 to control the amount of treating chemistry dispensed.

The treating chemistry detector 24 may include one or more sensors for sensing the amount of treating chemistry in each of the multiple cartridges 14-17. Multiple chemistry detectors 24 have been illustrated, with at least one detectors 24 provided for each of the multiple cartridges 14-17. A detector lead 25 couples each of the detectors 24 to the controller 30. With this configuration, each treating chemistry detector 24 may output a first signal indicative of the amount of treating chemistry in each of the corresponding multiple cartridges 14-17. It has also been contemplated that one treating chemistry detector 24 may be used to sense the amount of treating chemistry in all of the multiple cartridges 14-17.

Each treating chemistry detector 24 may be a resistivity sensor having a pair of spaced electrodes in contact with the treating chemistry and capable of generating a signal proportional to the level of the treating chemistry in each of the multiple cartridges 14-17. Each treating chemistry detector 24 may also be an optical sensor, such as a refractive index sensor containing a transmitter and a sensor whereby a beam of light may be projected onto the treating chemistry surface from the transmitter back to the sensor, which generates a signal consistent with either the chemistry or air to determine if the treating chemistry is present in each of the multiple cartridges 14-17. Each treating chemistry detector 24 may also be a height transducer capable of generating a signal proportional to the height (and thus the volume) of the treating chemistry in each of the multiple cartridges 14-17. Alternatively, each treating chemistry detector 24 may be a level sensor such as a float or reed switch that may switch on or off when the fluid reaches a certain level in each of the multiple cartridges 14-17.

Alternatively, the treating chemistry detector 24 may merely recognize that each of the multiple cartridges 14-17 is received within the base 12. In this manner the sensor 24 may be an indirect means for determining the amount of treating chemistry in each of the multiple cartridges 14-17. The amount of treating chemistry in each of the multiple cartridges 14-17 may be inferred based on detected conditions of the dispensing cartridge assembly 10 that indicate when each of the multiple cartridges 14-17 is received within the base 12 and operations of the dispensing cartridge assembly 10. For example, the sensor 24 may be used to determine when the cartridge 14 is received within the base 12. If the cartridge 14 is detected as having been inserted into the base 12, the controller 30 may infer that the user has inserted a full cartridge having a predetermined number of doses into the dispensing cartridge assembly 10. Every time the dispensing cartridge assembly 10 dispenses from the cartridge 14 the controller 30 may infer that a predetermined number of doses are left in the cartridge 14. In this manner an amount of treating chemistry or remaining number of doses, in the removable dispensing cartridge 14 may be determined by the controller 30.

Regardless of the type of treating chemistry detector 24 the signals output from the treating chemistry detectors 24 may be delivered to the controller 30 through the detector leads 25. The foregoing descriptions are merely exemplary treating chemistry detector locations and it may be understood that other locations may be utilized for a treating chemistry detector 24. For example, a treating chemistry detector 24 may be incorporated into the pump assembly 22.

The illumination detector 26 may include one or more sensors for sensing the amount of illumination around the dispensing cartridge assembly 10. An illumination detector lead 27 may electrically couple the illumination detector 26 with the controller 30. The illumination detector 26 may output a second signal indicative of the ambient illumination. Non-limiting examples of illumination detectors 26 include a CCD detector, a CMOS camera, a photo-detector, a photodiode, a silicon detector and combinations thereof for sensing ambient light. Regardless of the type of illumination detector 26 a signal output from the illumination detector 26 may be delivered to the controller 30 through the illumination detector lead 27.

The indicator 28 may be any type of indicator capable of outputting a human-detectable signal. It may be easily understood that a human-detectable signal is any signal capable of being detected by a user. Such indicators may include a visible or light-type indicator or an audible-type indicator or any combination of visible or audible human-detectable signals. Examples of light type indicators may include an incandescent lamp, a light emitting diode (LED), or an array of several LEDs. It should be noted that the light type indicator may produce a single light pulse or a series of light pulses. Examples of audible indicators may include a piezoelectric sound generator, speaker sound generator, or electro-magnetic sound generator, or any similar sound generator capable of producing a beep, a series of beeps, an audible sound, or voice messages. The indicator 28 may indicate a general status of the dispensing cartridge assembly 10 as well as a problem condition such as a low amount of treating chemistry in one of the multiple cartridges 14-17.

The controller 30 may be provided with a memory 40 and a central processing unit (CPU) 42. The memory 40 may be used for storing control software, which may be executed by the CPU 42. The memory 40 may be used to store information, such as a database or table. The memory 40 may also be used to store data received from one or more components of the dispensing cartridge assembly 10, such as the chemistry detector 24 and the illumination detector 26, which may be communicably coupled with the controller 30. The controller 30 may also be operably coupled with indicator 28 for communicating information to the user. The controller 30 may also receive input from one or more sensors 44. Non-limiting examples of sensors that may be communicably coupled with the controller 30 include a temperature sensor, turbidity sensor, or humidity sensor. Such a sensor 44 may be coupled to the controller 30, which receives the output from the sensor 44.

The anticipated use environment of the dispensing cartridge assembly 10 generally cannot accommodate the dispensing cartridge assembly 10 being wired to a power source. Accordingly, the power source 31 may be a wireless power source allowing the dispensing cartridge assembly 10 to be self-contained and in some exemplary approaches, self-sufficient. The power source 31 may be any type of power storage device non-limiting examples of which include a battery, a flywheel, or a capacitor. The power source 31 may be located in the base 12 behind a water-tight cover (not shown) such that it may be readily accessible by a user.

When the multiple cartridges 14-17 are received within the base 12, the pump assembly 22 may selectively fluidly couple the multiple cartridges 14-17 to an outlet 34 formed in the housing 20. The pump assembly 22 may control the dosing of the treating chemistry from the multiple cartridges 14-17 through the outlet 34 to the surroundings of the base 12. The pump assembly 22 may be operably coupled with the controller 30 such that the controller 30 may control the operation of the pump assembly 22 to thereby control the dosing of the treating chemistry from the multiple cartridges 14-17 through the outlet 34 to the surroundings of the base 12. In this manner, the dispensing cartridge assembly 10 may function as a bulk dispensing system, which may dispense treating chemistry to the environment surrounding the dispensing cartridge assembly 10.

When the multiple cartridges 14-17 are received within the base 12, the chemistry detector 24 may detect an amount of treating chemistry in the multiple cartridges 14-17 and the illumination detector 26 may detects an amount of illumination surrounding the base 12. The controller 30 may be operably coupled with the chemistry detector 24 and the illumination detector 26 such that they may communicate with the controller 30. The indicator 28 may also be operably coupled with the controller 30 such that the controller 30 may cause the indicator to emit a human-detectable signal based upon information received from the chemistry detector 24 and the illumination detector 26. The power source 31 may provide electrical power to pump assembly 22, chemistry detector 24, illumination detector 26, indicator 28, and controller 30 through electrical transmission wires connected thereto.

Figure 2:
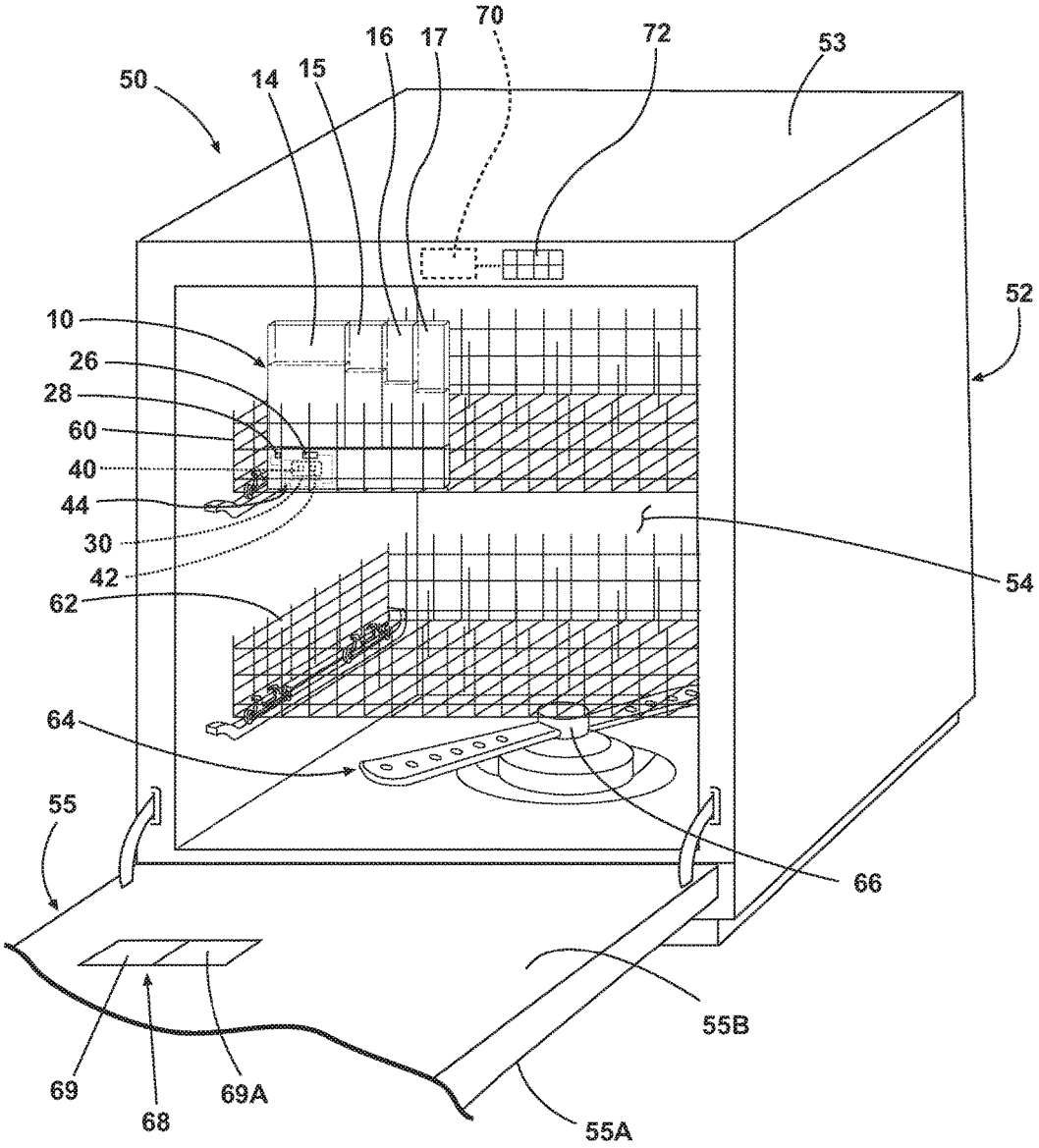
FIG. 2 is a schematic perspective view of a dishwasher comprising a dispensing system in accordance aspects of the present disclosure.

FIG. 2 illustrates one anticipated environment for the dispensing cartridge assembly 10 in the form of an automated dishwasher 50. The dishwasher 50 shares many features of a conventional automated dishwasher, which will not be described in detail herein except as necessary for a complete understanding of aspects of the disclosure.

The dishwasher 50 includes a chassis 52 which contains a wash tub 53 that defines an open-faced treating chamber 54. A cover or door 55 may be moveably mounted to the chassis 52 between an open position, as shown in FIG. 2, wherein the user can access the treating chamber 54, and a closed position, wherein the door 55 covers or closes the open face of the treating chamber 54 in a conventional fashion. The door 55 comprises an outer panel 55A and an inner panel 55B which faces the treating chamber 54 when the door 55 is in the closed position.

While a conventional dishwashing unit having a door 55 for a cover is illustrated in FIG. 2, the non-integrated dispenser 10 could also be placed in other types of dishwashing units such as in-sink dishwashers or drawer dishwashers including drawer dishwashers having multiple compartments. In the case of such drawer dishwashers wherein the drawer forms a treating chamber and is moveable in and out of a chassis or cabinet the chassis or cabinet overlying the drawer when the drawer is closed acts as a cover for selectively covering or closing the open face of the drawer. The non-integrated dispenser may also be placed in other appliances that require the dispensing of treating chemistries, such as clothes washers.

Utensil holders in the form of upper and lower utensil racks 60, 62 are located within the treating chamber 54 and receive utensils for washing. The upper and lower racks 60, 62 may be mounted for slidable movement in and out of the treating chamber 54 for ease of loading and unloading. As used in this description, the term "utensil(s)" is intended to be generic to any item, single or plural, that may be treated in the dishwasher 10, including, without limitation; dishes, plates, pots, bowls, pans, glassware, and silverware.

The dishwasher 50 further includes a liquid system 64 for supplying, recirculating, and spraying liquid throughout the treating chamber 54. The liquid spraying system 64 is well known and may include components such as a rotatable spray arm 66 positioned beneath the lower utensil rack 62. The dishwasher 50 may further comprise other conventional components such as additional spray arms or nozzles, a sump, a recirculation or drain pump, a heating unit, a filter etc.

An integrated dispensing system 68 may be carried by the door 55 and may include a single use dispenser 69 configured to store a single dose of treating chemistry. The single use dispenser 69 may comprise a dispenser found in many contemporary automatic dishwashers, which delivers or dispenses treating chemistry to the treating chamber 54 during a cleaning cycle of the dishwasher 50. The dispensing system 68 may also include a rinse aid dispenser 69A for dispensing rinse aid to the treating chamber 54 at an appropriate time during the cleaning cycle and can be configured to receive a single dose of rinse aid.

A controller 70 may also be included in the dishwasher 50, which is operably coupled to various components of the dishwasher 50 to implement a cycle of operation. The dishwasher 50 can be preprogrammed with a number of different cycles of operation from which a user may select one cycle of operation to clean a load of utensils. Examples of cycle of operations include normal, light/china, heavy/pots and pans, and rinse only. A control panel or user interface 72 coupled to the controller 70 may be used to select a cycle of operation can be provided on the dishwasher 50. The user interface 72 may include operational controls such as dials, lights, switches, and displays enabling a user to input commands to the controller 70 and receive information.

The controller 70 may also receive input from one or more sensors, which are known in the art and not shown for simplicity. Non-limiting examples of sensors that may be communicably coupled with the controller 70 include a temperature sensor, turbidity sensor to determine the soil load associated with a selected grouping of utensils, such as the utensils associated with a particular area of the treating chamber and a sensor for determining a load value at selected locations within the dishwasher 50. The load value may be reflective of either or both a utensil load, i.e. the number and/or size of the utensils in the dishwasher, and/or a soil load, i.e. the quantity of soil on the utensils.

The dispensing cartridge assembly 10 may be placed anywhere within the treating chamber 54 and may act as a removable bulk dispensing assembly for the dishwasher 50. Most practically, the dispensing cartridge assembly 10 will be placed where the user may easily access it. FIG. 2 illustrates that the dispensing cartridge assembly 10 may be placed within the upper utensil rack 60. It has been contemplated that the dispensing cartridge assembly 10 may be positioned elsewhere in the dishwasher 50, such as on the surface of the inner panel 55B, within the lower utensil rack 62, or that it may be mounted to a portion of the tub 53.

When the dispensing cartridge assembly 10 is removably received within the treating chamber 54 the multiple cartridges 14-17 may be filled with different types of treating chemistries. Each of the multiple cartridges 14-17 may be designated as a reservoir for holding a certain type of treating chemistry. For example, cartridges 14 and 15 may each be associated with a detergent, cartridge 16 may be associated with a spot reducer or rinse agent, and cartridge 17 may be associated with a rinse agent. The dispensing cartridge assembly 10 and the integrated dispensing system 68 may both be operated such that they dispense treating chemistry during the cycle of operation being run by the dishwasher. The remainder of this portion of the disclosure however pertains only to the dispensing of treating chemistry by the dispensing cartridge assembly 10.

During operation of the dishwasher 50, the dispensing cartridge assembly 10 may determine when bulk dispensing may be desired and then dispense appropriate treating chemistry when that time comes. More specifically, when the dispensing cartridge assembly 10 is located within the treating chamber 54 the temperature and/or humidity inside the treating chamber 54 may be detected by the sensor 44. The controller 30 may then utilize the temperature and humidity readings obtained from the output of the sensor 44 to determine when treating chemistry from the multiple cartridges 14-17 should be dispensed and control the operation of the dispensing cartridge assembly 10 accordingly. That is, based on the temperature and humidity readings output by the sensor 44 to the controller 30 the dispensing cartridge assembly 10 may determine at what point the cycle of operation is at and when treating chemistry should be dispensed.

When it is determined that treating chemistry should be dispensed by the dispensing cartridge assembly 10, the controller 30 may act to control the components of the dispensing cartridge assembly 10 to dispense the appropriate treating chemistry. For example, the pump assembly 22 may be activated to dose treating chemistry into the treating chamber 54. The pump assembly 22 may output a single dose of treating chemistry during the single cycle of operation. Dosing of the treating chemistry does not need to be done all at one time. For example, smaller amounts of treating chemistry, in total equal to a full single dose, may be dispensed by the pump assembly 22 at separate times throughout the cycle of operation.

During operation of the dispensing cartridge assembly 10, the controller 30 may also receive input from components of the dispensing cartridge assembly 10 and act to control other individual components of the dispensing cartridge assembly 10 accordingly. This may take place regardless of the operation of the dishwasher 50. For example, when the dispensing cartridge assembly 10 is powered by the power unit 31 the controller 30 may receive a first signal from the chemistry detector 24 indicative of the amount of treating chemistry in the treating chemistry reservoirs. If the controller 30 determines that a low level of treating chemistry exists the controller 30 may activate the indicator 28 to emit the human-detectable signal to alert a user that one of the multiple cartridges 14-17 needs to be refilled or replaced.

It may be understood that the power source 31 does not have endless supplies of power and that although the power source 31 may be replaced when it no longer provides power to the dispensing cartridge assembly 10 that repeated replacement of the power source 31 may become tedious for a user. Thus, the usage of power should be minimized and the dispensing cartridge assembly 10 made as efficient as possible. As a user may not always be present in the vicinity of the dispensing cartridge assembly 10, a human-detectable signal emitted from the indicator 28 may not always be detected by a user and this may result in an inefficiency of the dispensing cartridge assembly 10. Thus, to ensure that the human-detectable signal is emitted when a user will likely be present to detect it, the controller 30 may be capable of activating the indicator 28 only when it has been determined that a predetermined amount of illumination indicative of the door 55 being at least partially opened is present.

Figure 3:
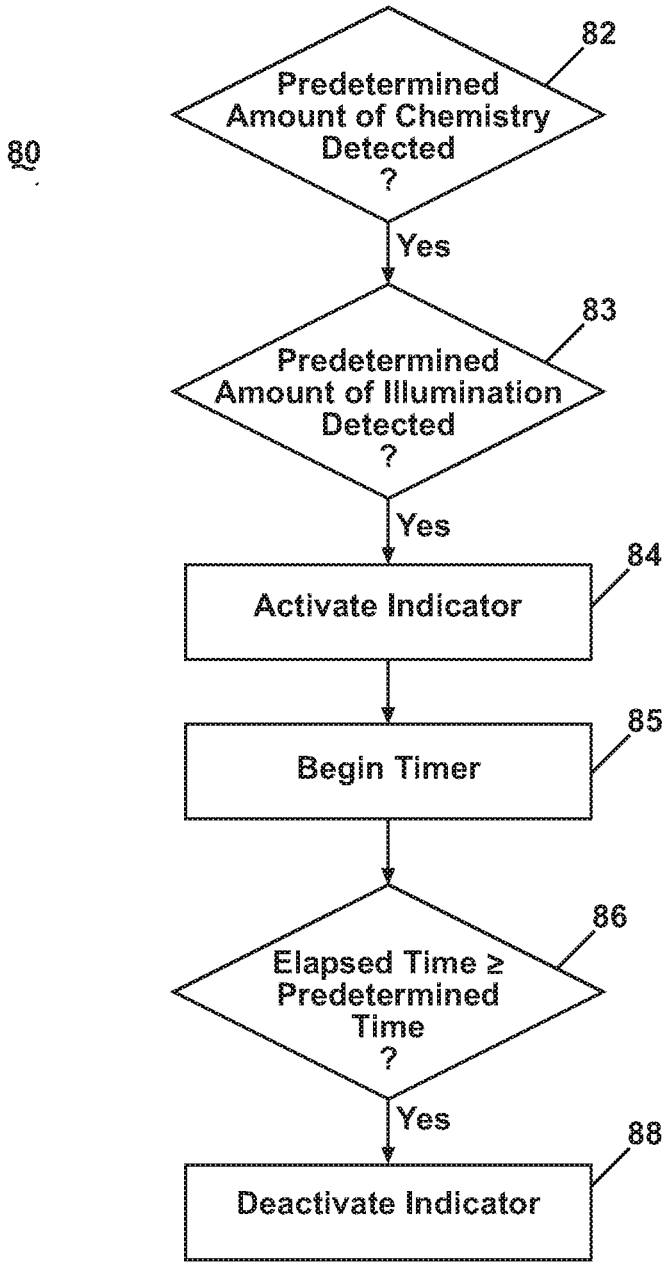
FIG. 3 is a flow chart depicting one method of operating the non-integrated dispenser in a household dishwasher in accordance with the present disclosure.

Referring to FIG. 3, a flow chart of one method 80 of operating the dispensing cartridge assembly 10 to emit such a human-detectable signal is shown. The sequence of steps depicted is for illustrative purposes only, and is not meant to limit the method 80 in any way as it is understood that the steps can proceed in a different logical order or additional or intervening steps may be included without detracting from aspects of the present disclosure. The operating method 80 begins at 82, in which it is determined if a predetermined amount of treating chemistry is located in one of the multiple cartridges 14-17. For ease of explanation the remainder of the method 80 will be described with respect to the cartridge 14 although the method 80 may be used with any of the multiple cartridges 14-17.

At 82, the determination of the amount of treating chemistry in the cartridge 14 may be made using the chemistry sensor 24 to sense the amount of treating chemistry in the cartridge 14. After determining the amount of treating chemistry at 82, the controller 30 may determine if the determined amount of treating chemistry in the cartridge 14 is a predetermined amount. As the method is concerned with alerting a user to a low amount of treating chemistry, the predetermined amount may be an amount that is less than or equal to a low level of treating chemistry in the cartridge 14. Such a low level may be approximately 10-15% of the total capacity for treating chemistry in the cartridge 14. In the case where the controller 30 determines the number of doses in the cartridge 14, the low level of treating chemistry in the cartridge 14 may be equal to a predetermined number of doses of treating chemistry remaining in the cartridge 14. Alternatively, the low level of treating chemistry may indicate an empty reservoir. If in 82 it is determined that such a predetermined low amount of treating chemistry is present, then the method proceeds to 83. If in 82 it is determined that such a predetermined low amount of treating chemistry is not present, then the method repeats 82 until such a predetermined low amount of chemistry is detected.

In 83 the controller 30 may determine if a predetermined amount of ambient illumination is present around the dispensing cartridge assembly 10. The controller 30 may receive a signal from the illumination detector 26 indicative of the amount of ambient illumination and may determine if such detected ambient illumination is a predetermined amount. As the method is concerned with alerting a user to a low amount of treating chemistry only when the door 55 is at least partially open, the predetermined amount of illumination may correlate to a level greater than or equal to an amount of ambient illumination expected when the door 55 is at least partially opened. For example, the predetermined amount of illumination may be greater than 30 lux or may be some predetermined amount depending on the anticipated lighting conditions. If in 83 it is determined by the controller 30 that such a predetermined amount of illumination, indicative of the door being at least partially opened, is present, then the method proceeds to 84. If in 83 it is determined that such a predetermined amount of illumination, indicative of the door being at least partially opened, is not present, then the method repeats 83 until such a predetermined amount of illumination is detected.

At 84, the indicator 28 may be activated such that it outputs a human-detectable signal such as a visible signal or an audible signal or a combination thereof. At 85, a timer may be started so that the controller 30 may receive a signal indicative of the elapsed time from the time the indicator 28 was activated. At 86, the controller 30 may be determined if the elapsed time is equal to or greater than a predetermined time. As the method is concerned with alerting a user when the user is around as well as conserving power, the predetermined amount of time may correlate to a time wherein it may be reasonably assumed that a user may notice the alert and determine what the alert is indicating as well as a time that would not allow too much power to be drained from the power source 31. An example of such a predetermined time may be 5 minutes.

If in 86, the controller 30 determines that the elapsed time is determined to be equal to or greater than the predetermined time, then the method proceeds to 88 where the indicator is deactivated and the method is finished. If the elapsed time is determined to be less than the predetermined time then the indicator remains activated and the method repeats 86 until it is determined that the elapsed time is greater than or equal to the predetermined time. It has been contemplated that the user may also turn off the indicator 28 at any time prior to it being determined that the elapsed time is greater than or equal to the predetermined time, effectively ending the method.

Figure 4:
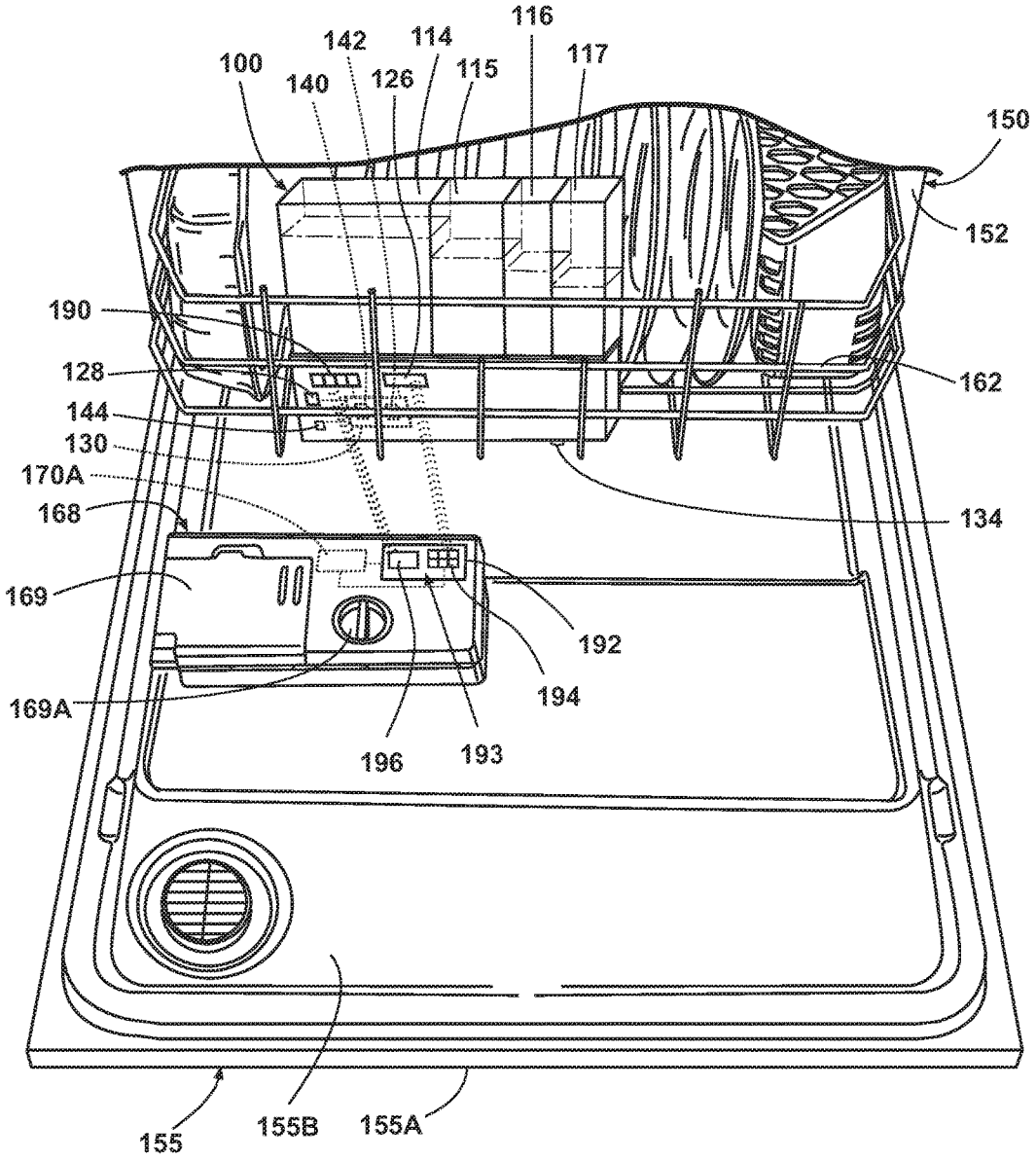
FIG. 4 is a partial perspective view of a portion of a dishwasher, including a non-integrated dispenser, according to an aspect of the present disclosure.

FIG. 4 is a partial perspective view of a portion of a dishwasher 150 in which a non-integrated dispenser 100 according to a second aspect of the present disclosure. The dishwasher 150 with the non-integrated dispenser 100 contained therein is similar to the dishwasher 55 with the non-integrated dispenser 10 contained therein previously described and therefore, like parts will be identified with like numerals increased by 100, with it being understood that the description of the like parts of the non-integrated dispenser 10 and dishwasher 55 applies to the non-integrated dispenser 100 and dishwasher 150, unless otherwise noted.

One difference between the non-integrated dispenser 10 and dishwasher 55 described above and the non-integrated dispenser 100 and dishwasher 150 is that the non-integrated dispenser 100 and dishwasher 150 have the ability to communicate with each other through light communications. By way of example, if the indicator 128 of the non-integrated dispenser 100 is not an LED then the non-integrated dispenser 100 may include an additional non-integrated dispenser LED, which may include an infrared LED, or array of several non-integrated dispenser LEDs indicated as 190 in FIG. 4. Such non-integrated dispenser LEDs 190 may be operably coupled with the controller 130 such that the controller 130 may selectively activate each of the non-integrated dispenser LEDs 190.

Another difference is that the integrated dispensing system 168 has been illustrated as including a window 192 behind which a communication module 193 may be mounted. The communication module 193 may include a PCB (not shown), at least one LED 194, and a receiver 196, as well as any other necessary electronics may be installed. The communication module may be operably coupled to a secondary controller 170*a*, which may be operably coupled to the controller 170. The controller 170*a* may selectively activate each of the LEDs 194. Alternatively, instead of having a secondary controller 170 the communication module 193 may be operably coupled directly to the controller 170.

Although an array having several LEDs 194 has been contemplated it may be understood that a single LED may be used. The array of several LEDs 194 is positioned such that the LEDs may shine through the window 192. The receiver 196 may include one or more sensors for sensing illumination provided by the non-integrated dispenser LEDs 190. Non-limiting examples of types of receivers 196 include a CCD detector, a CMOS camera, a photo-detector, a photodiode, a silicon detector and combinations thereof for sensing ambient light. Regardless of the type of receiver 196 the signal output from the receiver 196 may be delivered to the controller 170*a*.

The non-integrated dispenser 100 has been illustrated as being positioned in the lower rack 162 at a position where the non-integrated dispenser LEDs 190 face the window 192. Although the non-integrated dispenser 100 may be placed in other areas inside the dishwasher 150, when the non-integrated dispenser LEDs 190 face the window 192 the non-integrated dispenser 100 and the dishwasher 150 may communicate with each other by sending and receiving LED light signals. The non-integrated dispenser 100 is already equipped with an illumination detector 126 which may be capable of receiving the signals sent from the communication module 193.

During operation the non-integrated dispenser 100 may dispense autonomously as described above or it may receive one or more communications in the form of light flashes, to command its dispensing of treating chemistry, from the communication module 193. More specifically, during operation of the dishwasher 150 the controller 170*a* may output a signal to the array of several LEDs 194 telling it what signals to flash. These visible LED signals may then be received by the illumination detector 126, which may then send them to the controller 130. The memory 140 and CPU 142 of the controller may then determine what signals were sent and how to operate the non-integrated dispenser 100 accordingly.

More specifically, the communication module 193 may flash signals to the non-integrated dispenser 100 telling it to dispense a particular treating chemistry. The non-integrated dispenser 100 may receive those signals, dispense the treating chemistry, and then signal back to the communication module that the treating chemistry has been dispensed. It has been contemplated that the specific timing between the signals may determine the command. Alternatively, the array of several LEDs may have varying colors, the specific colors flashed or the arrangement of flashes may determine the command.

It has been contemplated that the dishwasher 150 and non-integrated dispenser 100 may communicate with each other for a variety of reasons. For example, the non-integrated dispenser 100 may communicate to the dishwasher 150 that it has a cartridge with a low treating chemistry level and the dishwasher 150 may then alert the user. Alternatively, the non-integrated dispenser 100 may communicate with the dishwasher 150 such that the dispensing of treating chemistry from the non-integrated dispenser 100 and the dishwasher 150 may be coordinated.

Figure 5:
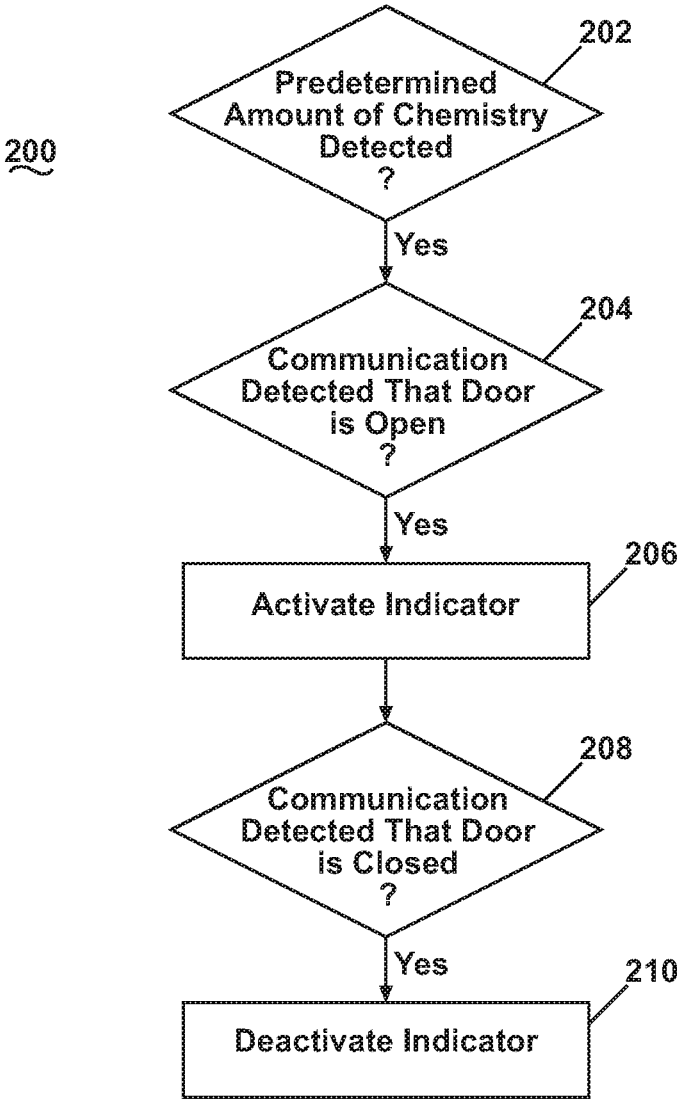
FIG. 5 is a flow chart depicting another method of operating the non-integrated dispenser in a household dishwasher in accordance with the present disclosure.

Further, it has also been contemplated that the dishwasher 150 may communicate to the non-integrated dispenser 100 that the door 155 is at least partially open such that the user may then be alerted by the non-integrated dispenser 100 when a low level of treating chemistry has been determined. Referring now to FIG. 5, a flow chart of one method 200 of operating the dispensing cartridge assembly 100 to emit such a human-detectable signal is shown. The operating method 200 is the same as the method 80, except that the communication module 193 may communicate with the controller 130. More specifically, it is illustrated at 204 that the controller 130 may determine if a communication has been received from the communication module 193 that the door 155 of the dishwasher 150 is at least partially open. In such a determination, the controller 130 will determine if it has received a signal from the illumination detector 126 indicative of a signal sent from the communication module 193 that the door 155 is at least partially open. If in 204 it is determined that the communication module 193 has not communicated that the door is at least partially open, then the method repeats 204 until such a communication is detected. If in 204 it is determined by the controller 130 that the communication module 193 has communicated that the door is at least partially open then the method moves onto 206 wherein the indicator 128 may be activated such that it outputs a human-detectable signal such as a visible signal or an audible signal or a combination thereof After the indicator 128 has been activated in 206, the method may continue to 208 wherein the controller 130 may determine if a communication has been received from the communication module 193 that the door 155 of the dishwasher 150 has been closed. In such a determination, the controller 130 will determine if it has received a signal from the illumination detector 126 indicative of a signal sent from the communication module 193 that the door 155 is closed.

If in 208 it is determined that the communication module 193 has not communicated that the door 155 is closed, then the indicator remains activated and the method repeats 208 until such a communication is detected. If in 208 it is determined by the controller 130 that the communication module 193 has communicated that the door 155 has been closed then the method moves onto 210 where the indicator is deactivated and the method is finished. It has been contemplated that after the indicator 128 has been activated a timer may be started as described above or that the user may also turn off the indicator 128 at any time.

It has been contemplated that the non-integrated dispenser 100 may alternatively be operated according to the method of operation 80 described above with reference to FIG. 3. The one caveat which must be discussed is that in 83 where the controller 130 may determine if a predetermined amount of ambient illumination is present around the dispensing cartridge assembly 100 the light given off by the communication module 193 would need to be taken into consideration. In such an instance, the predetermined amount of illumination indicative of the door 155 being at least partially open would have a higher range. Likely the controller 130 would look for a level of illumination that is approximately five to ten times greater than the light emitted by the communication module 193 to indicate that the door 155 is at least partially open.

The devices and methods described above offer many benefits including the ability to have a fully automated bulk dispenser that brings to a user's attention when it is low on treating chemistry instead of the user having to check for the treating chemistry level status. Further, the devices do so in an efficient and power saving way such that the user does not constantly have to replace the power supply. The devices and methods described above also allow consumers the flexibility of providing fully automated bulk dispensing with the option of manual filling. The non-integrated dispensers described above eliminate the need for the user to remove a supply of treating chemistry from a storage space, fill a dispenser, and replace the supply of treating chemistry each time the dishwasher is operated; however, the user is given the option of doing so when they desire.

While the methods disclosed above are described with respect to a household dishwasher having only one non-integrated dispenser and one integrated dispensing system, it is understood that the method can be applied to a household dishwasher have a greater number of either type of dispensers with reasonable modifications. It is further understood that the household dishwashers may be operated in accordance with methods other than those described herein.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher, comprising:
- a tub having an open face and at least partially defining a treating chamber configured for holding dishes during a cycle of operation;
- a door moveably mounted between an opened position, wherein the treating chamber is accessible, and a closed position, wherein the door closes the open face of the tub; and
- a dispensing assembly, comprising:
  - at least one treating chemistry container configured to store a treating chemistry and selectively fluidly coupled to the treating chamber;
  - a sensor configured to detect a characteristic of the dispensing assembly and output a first signal based thereon;
  - an illumination detector outputting a second signal indicative of ambient illumination;
  - an indicator outputting a human-detectable signal; and
  - a controller receiving the first signal and the second signal and operably coupled to the indicator to activate the indicator to emit the human-detectable signal when the ambient illumination is indicative of the open face being at least partially opened and wherein the human-detectable signal is based on the detected characteristic of the dispensing assembly.

2. The dishwasher of claim 1 wherein the dispensing assembly further comprises a base configured to receive the at least one treating chemistry container.

3. The dishwasher of claim 2 wherein the sensor is located in the base and outputs the first signal indicative of at least one of a presence of the at least one treating chemistry container or an absence of the at least one treating chemistry container.

4. The dishwasher of claim 3 wherein the controller is configured to track when the at least one treating chemistry container is received within the base.

5. The dishwasher of claim 4 wherein the controller is further configured to track usage of the treating chemistry in the at least one treating chemistry container and the detected characteristic is based thereon.

6. The dishwasher of claim 5 wherein the controller is further configured to determine an amount of the treating chemistry in the at least one treating chemistry container based on when the at least one treating chemistry container is received within the base and usage of the treating chemistry and the human-detectible signal is based thereon.

7. The dishwasher of claim 6 wherein the controller is configured to at least one of: determine a low amount of the treating chemistry from the first signal and wherein the human-detectable signal indicates the low amount of the treating chemistry in the at least one treating chemistry container, determine an emptiness of the treating chemistry in the at least one treating chemistry container and wherein the human-detectable signal indicates the emptiness of the at least one treating chemistry container, or determine a remaining number of doses of the treating chemistry in the at least one treating chemistry reservoir and wherein the human-detectable signal indicates the remaining number of doses.

8. The dishwasher of claim 1 wherein the first signal is related to a volume, level, or amount of treating chemistry in the at least one treating chemistry container.

9. The dishwasher of claim 8 wherein the controller is configured to at least one of: determine a low amount of the treating chemistry from the first signal and wherein the human-detectable signal indicates the low amount of the treating chemistry in the at least one treating chemistry container, determine an emptiness of the treating chemistry in the at least one treating chemistry container and wherein the human-detectable signal indicates the emptiness of the at least one treating chemistry container, or determine a remaining number of doses of the treating chemistry in the at least one treating chemistry reservoir and wherein the human-detectable signal indicates the remaining number of doses.

10. The dishwasher of claim 1, further comprising multiple treating chemistry containers.

11. The dishwasher of claim 1 wherein the controller is configured to cease the emitting of the human-detectable signal after a predetermined time.

12. A dispensing assembly, comprising:

at least one treating chemistry container configured to store a treating chemistry and selectively dispense the treating chemistry;

a sensor configured to detect a characteristic of the dispensing assembly and output a first signal based thereon;

an illumination detector outputting a second signal indicative of ambient illumination;

an indicator outputting a human-detectable signal; and a controller receiving the first signal and the second signal and operably coupled to the indicator to activate the indicator to emit the human-detectable signal when the ambient illumination is indicative of a predetermined amount of illumination and wherein the human-detectable signal is based on the detected characteristic of the dispensing assembly.

13. The dispensing assembly of claim 12 wherein the dispensing assembly further comprises a base configured to receive the at least one treating chemistry container and wherein the sensor is located in the base and outputs the first signal indicative of at least one of a presence of the at least one treating chemistry container or an absence of the at least one treating chemistry container.

14. The dispensing assembly of claim 13 wherein the controller is configured to track when the at least one treating chemistry container is received within the base and usage of the treating chemistry in the at least one treating chemistry container and the detected characteristic is based thereon.

15. The dispensing assembly of claim 14 wherein the controller is further configured to determine an amount of the treating chemistry in the at least one treating chemistry container based on when the at least one treating chemistry container is received within the base and usage of the treating chemistry and the human-detectible signal is based thereon.

16. The dispensing assembly of claim 15 wherein the controller is configured to at least one of: determine a low amount of the treating chemistry from the first signal and wherein the human-detectable signal indicates the low amount of the treating chemistry in the at least one treating chemistry container, determine an emptiness of the treating chemistry in the at least one treating chemistry container and wherein the human-detectable signal indicates the emptiness of the at least one treating chemistry container, or determine a remaining number of doses of the treating chemistry in the at least one treating chemistry reservoir and wherein the human-detectable signal indicates the remaining number of doses.

17. The dispensing assembly of claim 12 wherein the first signal is related to a volume, level, or amount of treating chemistry in the at least one treating chemistry container.

18. The dispensing assembly of claim 17 wherein the controller is configured to at least one of: determine a low amount of the treating chemistry from the first signal and wherein the human-detectable signal indicates the low amount of the treating chemistry in the at least one treating chemistry container, determine an emptiness of the treating chemistry in the at least one treating chemistry container and wherein the human-detectable signal indicates the emptiness of the at least one treating chemistry container, or determine a remaining number of doses of the treating chemistry in the at least one treating chemistry reservoir and wherein the human-detectable signal indicates the remaining number of doses.

19. The dispensing assembly of claim 12, further comprising multiple treating chemistry containers.

20. The dispensing assembly of claim 12 wherein the controller is configured to cease the emitting of the human-detectable signal after a predetermined time.

* * * * *